US009944420B2

(12) United States Patent
Heeman et al.

(10) Patent No.: US 9,944,420 B2
(45) Date of Patent: Apr. 17, 2018

(54) APPARATUS AND METHOD FOR ORIENTING A TUBULAR HEAT-SHRINKABLE SLEEVE RELATIVE TO A CONTAINER

(71) Applicant: FUJI SEAL INTERNATIONAL INC., Osaka-shi, Osaka (JP)

(72) Inventors: Frederik Gerardus Heeman, Venlo (NL); Joop Michael Petrus Peeters, Kessel (NL)

(73) Assignee: FUJI SEAL INTERNATIONAL, INC., Osaka-shi (JP)

( * ) Notice: Subject to any disclaimer, the term of this patent is extended or adjusted under 35 U.S.C. 154(b) by 403 days.

(21) Appl. No.: 14/930,062

(22) Filed: Nov. 2, 2015

(65) Prior Publication Data

US 2016/0122054 A1 May 5, 2016

(30) Foreign Application Priority Data

Oct. 31, 2014 (NL) ..... 2013723

(51) Int. Cl.

| | |
|---|---|
| ***B65B 11/00*** | (2006.01) |
| ***B65B 41/18*** | (2006.01) |
| ***B65B 43/42*** | (2006.01) |
| ***B65B 53/06*** | (2006.01) |
| ***B65C 3/06*** | (2006.01) |
| ***B65C 9/40*** | (2006.01) |

(52) U.S. Cl.

CPC ..... *B65B 41/18* (2013.01); *B65B 43/42* (2013.01); *B65B 53/06* (2013.01); *B65C 3/065* (2013.01); *B65C 9/40* (2013.01)

(58) Field of Classification Search

CPC ..... B65D 85/55
USPC ..... 53/397–399
See application file for complete search history.

(56) References Cited

PUBLICATIONS

Jul. 30, 2015 Search Report issued in Dutch Patent Application No. 2013723.
Oct. 31, 2014 Written Opinion issued in Dutch Patent Application No. 2013723.

*Primary Examiner* — Lori Baker
(74) *Attorney, Agent, or Firm* — Oliff PLC

(57) ABSTRACT

An apparatus and method for orienting a tubular heat-shrinkable sleeve relative to a container. The apparatus includes a sleeve orientation unit that uses a moveable support surface to hold and rotate the sleeve relative to the container. To that end, the apparatus further includes a determining unit for determining an angular position difference between the container and the sleeve relative to an axis perpendicular to the conveyor belt on which the container is transported. The angular position difference is used to control the movement of the support surface.

15 Claims, 5 Drawing Sheets

APPARATUS AND METHOD FOR ORIENTING A TUBULAR HEAT-SHRINKABLE SLEEVE RELATIVE TO A CONTAINER

The present invention is related to an apparatus and method for orienting a tubular heat-shrinkable sleeve relative to a container.

Heat-shrinkable sleeves are known in the art. These sleeves can be used to add decoration or other information to a container. For instance, a sleeve may comprise a printed image to display a brand name or information regarding the contents of the container. Such sleeves are commonly used in the food and beverages industry, beauty products industry, etc.

The sleeves are typically arranged around the containers using a high throughput process in which the containers are guided using conveyor belts. Separate sleeving stations may be arranged to arrange a sleeve around the container. This is normally done from either the top side or bottom side relative to the conveyor belt. The application of sleeves is known in the art and a more detailed explanation is therefore deemed unnecessary.

After arranging the sleeves around the container, the container and sleeve are transported through a shrinking device, such as a heating tunnel, wherein under the application of heat, the heat-shrinkable sleeve shrinks thereby fixedly attaching itself to the container.

It is important that the sleeve fixedly attaches itself at an intended position on the container. In past years, the container was highly symmetric. Consequently, there existed a high tolerance with respect to the placement accuracy of the sleeves.

A recent trend in the industry is to use highly asymmetric containers. An example thereof is a container which has the shape of a cartoon character. Clearly, the use of such containers puts a high requirement on the placement accuracy of the sleeve. More in particular, the angular orientation of the sleeve with respect to the container needs to be accurate. Here, within the context of the present invention, angular orientation will be defined relative to an axis perpendicular to the conveyor belt that is used to transport the containers or relative to a longitudinal axis of the container.

Solutions are known for mutually orienting the sleeve and container. In these solutions the container is moved, more in particularly rotated, to position the container such that the sleeve, which is assumed to have a well-defined orientation, can be placed accurately on the container. Typically, the containers are gripped at the top side, for instance at the lid or cap of the container. Separate container belts may be used that touch the lid or cap of the container to be rotated. The conveyor belts are arranged along the transport direction of the main conveyor belt that supports the containers. In some applications, a separate conveyor belt is arranged on either side of the main conveyor belt, wherein the two conveyor belts may move in opposite directions and at a different speed as the main conveyor belt. Consequently, as the container is conveyed by the main conveyor belt it is rotated by the two oppositely arranged conveyor belts.

The known solution described above has some drawbacks. A first drawback is the throughput that can be achieved with this solution. As the container, which is typically filled, is relatively heavy, it takes some time before the container is rotated. The forces exerted by the conveyor belts, which are arranged on either side of the main conveyor belt, onto the container cannot be too excessive as this may cause the container to tumble. Hence, the rotation takes time, and, because the container is moving, the apparatus responsible for the rotation must extend along a considerable length.

A further drawback related to the rotation of the containers by gripping the lid or cap is related to the amount of force that must be exerted by a consumer for opening the lid or cap. It has been shown that the forces exerted onto the cap or lid for the purpose of rotating the container may result in the cap or lid being fastened too tightly. The opposite may also occur, wherein the cap or lid is loosened during the process of rotating the container.

An even further drawback is related to the achievable mutual orientation of the sleeve and container. More in particular, a current trend in the industry is to apply various processing techniques after the sleeve has been shrunk onto the container. An example of such processing technique is embossing or cutting parts of the sleeve away using a laser to make room for the handle of the container. In particular when the container is highly asymmetric, the achievable orientation of sleeve and container using the known solution is not satisfactory.

Still another drawback is also related to the use of asymmetric containers. In case the container has a particular shape, for instance a cartoon character shape, and the sleeve comprises a printed image that should correspond to this shape, the sleeve must be arranged even more accurately on the container. As an example, the container comprises protrusions on a lateral side of the container that correspond to the nose of a cartoon character. Here, the printed image could correspond to an image of a nose, eyes etc. It should be obvious that this image must be aligned perfectly in order to achieve an appealing look of the final product. Even if the container can be orientated perfectly with respect to the sleeve, it cannot be guaranteed that the printed image on the sleeve is positioned sufficiently accurate. This is related to the fact that the process of printing an image on the sleeve is also subjected to tolerances. The known solution does not account for these tolerances.

EP 1457427B1 discloses an apparatus for controlling the relative position of a bottle and a sleeve. A video system may be used to monitor the orientation of the sleeve relative to the bottle. In the known apparatus, a feedback loop and reorienting mechanism are used to correct misalignment between the bottle and the sleeve. The reorienting mechanism may be a mechanical belt such as a belt system for adjusting the sleeve position.

The applicant has found that the known apparatus is not able to provide a constant quality of the sleeve when it is shrunk around the container.

It is an object of the present invention to provide a solution to one or more of the problems identified above.

According to a first aspect, this object has been achieved with an apparatus which is configured for orienting a tubular heat-shrinkable sleeve relative to a container around which the heat-shrinkable sleeve has been arranged, wherein the sleeve has not yet been finally shrunk. The sleeve is being transported along a transport direction, preferably either in a continuous or an intermittent manner. The apparatus could for instance comprise a conveyor having a moveable conveyor belt for transporting the container in the transport direction, and could comprise a determining unit for determining an angular position difference between the container and the sleeve, preferably relative to an axis perpendicular to the conveyor belt. Typically, a conveyor belt comprises a flat surface on which the container is supported. The angular orientation may be defined relative to an axis perpendicular to this flat surface. However, the angular orientation may also be defined relative to another axis, preferably relative to the longitudinal axis of the sleeve.

Prior to orienting the sleeve relative to the container, the heat shrinkable sleeve has not yet been finally shrunk. In some applications, the sleeve may nevertheless be loosely attached to the container not excluding the case in which a small part of the sleeve has been shrunk to keep the sleeve in place during transport. In this situation, the process of orienting the sleeve relative to the container in accordance with the present invention breaks the connection between sleeve and container. Then, after the sleeve is properly orientated relative to the container, it may be finally shrunk in for instance a heat tunnel.

The apparatus according to the invention further comprises a sleeve orientation unit that comprises a support surface, preferably arranged downstream of the determining unit and preferably at least on one side of the conveyor belt, wherein the support surface is arranged at a distance from the container(s) that is or are transported preferably on the conveyor belt, and wherein the support surface is moveable in a direction parallel to the transport direction. The sleeve orientation unit could further comprise a support surface drive unit for moving the support surface at a predefined speed. The sleeve orientation unit comprises a holding unit configured to hold the sleeve against the support surface, and the sleeve orientation unit could comprise a control unit configured to determine a speed at which the support surface moves and/or a holding time during which the sleeve is held against the support surface based on the determined angular position difference and to control the holding unit and/or support surface drive unit using the determined holding time and/or speed.

According to an aspect of the invention, the sleeve orientation unit is configured is rotate the sleeve relative to the container in dependence of an angular position difference between the container and the sleeve by moving the support surface while the sleeve is held against the support surface.

During operation, the sleeve will be held against the support surface, whereas the container will generally not touch the support surface. Furthermore, the sleeve may move at a different speed along the transport direction than the container. Due to this difference in speed, the container may at some point in time hit the sleeve either at the front or back side of the container. If the sleeve is released at or just prior to that point in time, the sleeve will return to a position around the container in which the angular position relative to the container has been changed. This is particularly the case when the sleeve is held against a support surface on only one side of the conveyor belt.

The amount of change in angular position can be determined by varying the holding time during which the sleeve is held against the support surface and/or the speed of the support surface. It is also possible to not move the support surface at all, in which case the holding time is relatively short due to the large difference in speed between the support surface and the conveyor belt.

The present invention allows orienting the sleeve without exerting a force onto the sleeve that is directed towards the container. If such force is exerted, the sleeve may wrinkle or otherwise deform in a more or less unpredictable manner. When the force is removed, for instance at the end of the orienting, the sleeve will regain its natural form. The motion of the sleeve from the wrinkled or deformed state to its natural form will in general be accompanied by an unpredictable change in angular position of the sleeve relative to the container.

The sleeve orientation unit could be configured to rotate the sleeve relative to the support surface. In addition or alternatively, the sleeve orientation unit could be configured to rotate the sleeve while the sleeve is moving in the direction parallel to the transport direction.

To allow the sleeves to be rotated over a larger range of angles, a pair of the sleeve orientation units may be employed, wherein the sleeve orientation units are arranged on opposite sides of the conveyor belt. In this case, the control units of the sleeve orientation units may cooperate or may be integrated into the same unit.

The control unit may be configured to control the support surface drive unit to rotate the sleeve from a starting position to an end position, wherein the sleeve is rotated from the starting position directly to the end position, or the sleeve is first rotated from its starting position to a predetermined reference position, and then rotated from the reference position to the end position, or the sleeve is first rotated in a first direction over a first angle, and then rotated over a second angle in a second direction opposite to the first direction.

Changing the angular position of the sleeve only very slightly may be troublesome in some applications or with some materials due to the stick and slip phenomenon. To avoid this problem, the support surface may first move in a first direction, and then move in a second direction opposite to the first direction. A difference in speed at which and/or a time during which the support surface moves between the movements along the first and second directions may depend on the determined angular position difference. As a result, the sleeve may for instance turn 175 degrees clockwise followed by a rotation of 180 degrees counterclockwise. A net rotation of 5 degrees counterclockwise is achieved. Obtaining a 5 degrees rotation in this manner may be more reproducible than a single rotation of 5 degrees counterclockwise. This approach is particularly suitable if a pair of oppositely arranged sleeve orientation units is used.

As an example, the support surfaces of the oppositely arranged sleeve orientation units may each move at a speed that comprises a common part and a differential part, wherein the common parts are equal in both direction and magnitude, and wherein the differential parts are equal in magnitude but have an opposite direction. For example, the conveyor belt may be arranged to transport the container at a speed Vcontainer, and the support surfaces may move at a speed of Vsurface,1=Vcontainer+Vsleeve and Vsurface,2=Vcontainer−Vsleeve, wherein Vsurface,1 and Vsurface,2 represent the speeds of the support surfaces of a first and second sleeve orientation unit, respectively. Here, Vcontainer and Vsleeve represent the common and differential part, respectively. This configuration of speeds allows the sleeve to be rotated while it is moving at the same speed as the container. However, the invention is not limited to this configuration. For instance, the common part may be zero or at least different from the speed of the container.

The apparatus may further comprise a further determining unit configured for determining a further angular position difference between the container and the sleeve downstream of the sleeve orientation unit. At least one of a return unit and a rejection unit may be arranged downstream of the sleeve orientation unit, wherein the return unit is configured to return a container and sleeve to a position on the conveyor belt upstream of the sleeve orientation unit and determining unit if the further angular position difference exceeds a first predefined threshold, and wherein the rejection unit is configured to remove a container and sleeve from the conveyor belt if the further angular position difference exceeds a second predefined threshold.

The control unit may further be configured to determine a correlation between the angular position difference and control parameters for the support surface drive unit needed for correcting the difference, wherein the control unit is configured to determine the correlation using a self-learning algorithm that compares the angular position difference, the control parameters used for correcting this difference, and the further angular position difference observed after correcting the difference. Example control parameters may be the speed of the support surface(s), the holding time for each support surface, a time used for acceleration between different speeds of the support surface(s), etc.

The determining unit may comprise a first detector for detecting the angular position of the sleeve, preferably relative to the axis perpendicular to the conveyor belt, wherein the first detector preferably comprises an optical camera. For instance, the optical camera may be configured to detect folding lines or seams in the sleeve, a printed image on the sleeve, or other physical structures to determine the angular position. More in particular, the sleeve may comprise an identifiable first reference point, such as an area or feature in a printed image on the sleeve. The first detector may be configured to detect the angular position of the sleeve by identifying the first reference point, preferably relative to the axis perpendicular to the conveyor belt.

The angular position of the sleeve can be determined by comparing the identified first reference point to a corresponding first reference point in a first reference image, wherein the angular position associated with the first reference image and/or the first reference point in that first reference image is known. As an example, an optical camera may be used to record an image of the sleeve that is arranged around the container. The recorded image may be compared with a first reference image. The reference image may correspond to the image that has been printed on the sleeve. It may further correspond to a particular angular position of the sleeve. In this case, the sleeve position refers to the position of the printed image on the sleeve instead of the position of the physical sleeve itself. The reference image corresponds to a particular position of the printed image on the sleeve that is known. By comparing the reference image and recorded image, a deviation between images can be determined, for instance a shift or rotation, and from this deviation the angular position of the sleeve, e.g. the angular position of the printed image on the sleeve, may be determined. To determine the deviation, image matching techniques can be used. To this end, features or particular areas in the images can be identified. As an example, the position of a specific feature in the reference image, for instance the center region of a specific color patch, may be compared to the position of this same feature in the recorded image.

The container may comprise an identifiable second reference point, such as a physical structure, for example a recess or a protrusion, wherein the first detector is configured to determine the angular position difference from a distance between the first and second identifiable reference points. Hence, the angular position difference can be determined from a single recorded image of both the sleeve and container. Alternatively, the angular position of the container has a known value or has been set to a known value upstream of the determining unit and sleeve orientation unit, wherein the angular position difference is determined by the determining unit or the control unit by comparing the detected angular position of the sleeve with the known value. In this case, there is no need to determine the angular position of the container as this value is known.

The sleeve may comprise a folding line. Furthermore, the sleeve may have been arranged around the container, upstream of the sleeve orientation unit, in a manner that the orientation of the folding line relative to the container is known. For instance, a guiding unit may be arranged upstream of the sleeve orientation unit that engages the folding line and guides the sleeve to a position around the container, wherein the container itself has a know position. Alternatively, this position is detected using a detector similar to the first detector or the second detector that will be described later on. Such detector may be coupled to a container orientation unit that corrects the angular position of the container based on the detected angular position of the container. Accordingly, the angular position difference between the physical sleeve and the container may be known upstream of the sleeve orientation unit. However, this does not mean that the angular position of the sleeve of interest, meaning the angular position of an image printed on the sleeve is known. During printing the angular position of the sleeve relative to the folding line may have shifted. This angular offset between the image printed on the sleeve relative to an intended position of the image on the sleeve can be detected upstream of the apparatus according to the invention. Alternatively, this angular offset may be detected by the first detector, wherein the determining unit is configured to determine the angular position difference between the sleeve and container by comparing the angular offset and the known orientation of the folding line relative to the container.

The determining unit may comprise a second detector for detecting the angular position of the container, preferably relative to the axis perpendicular to the conveyor belt, wherein the second detector preferably comprises an optical camera. To this end, the container may comprise an identifiable second reference point, such as a physical structure, for example a recess or a protrusion, and wherein the second detector is configured to detect the angular position of the container by identifying the second reference point, preferably relative to the axis perpendicular to the conveyor belt. The angular position of the container can be determined by comparing the identified second reference point to a corresponding second reference point in a second reference image, wherein the angular position associated with the second reference image and/or the second reference point in that second reference image is known.

The first and second detectors may be combined, although the invention is not limited thereto. The determining unit may be configured to determine the angular position difference by subtracting the angular positions of the sleeve and the container as determined by the first and second detectors, respectively. Moreover, the first and second detectors may be identical. For instance, a single optical camera may be used to perform as the first and second detector, possibly simultaneously. In this last case, a single recorded image is used to determine the angular position difference.

The first and/or second detector may configure to detect the angular position of the sleeve and/or container from the side, the top and/or the bottom. Various techniques can be employed to determine the angular position. For instance, scanning techniques, such as laser scanning may be used to detect the angular position by identifying protrusions, recesses, seams, folding lines, etc.

The support surface may be formed by a supporting conveyor belt that is configured to support the sleeve along a predetermined length along the transport direction. Supporting in this context refers to the support surface being able to move the sleeve relative to the container.

The supporting conveyor belt may be wound around a pair of rollers/wheels that are spaced apart along the transport direction. Each supporting conveyor belt moves in the same or opposite direction as the main conveyor belt. Furthermore, the sleeve orientation unit may comprise a plurality of the supporting conveyor belts that are spaced apart. For instance, a plurality of supporting conveyor belts may be arranged vertically offset to each other.

The holding unit may comprise an injector for injecting a gaseous medium into the sleeve to push the sleeve against the support surface, and/or an electrostatic unit comprising a voltage source for applying an electrostatic voltage between the support surface and sleeve to attract the sleeve towards the support surface and to hold it there against using static electricity, and/or a vacuum unit being arranged for holding the sleeve against the support surface by applying a suction force through one or more openings. Here, it is noted that regardless of the type of holding unit used, it may be advantageous to apply a gaseous medium, such as pressurized gas, into the sleeve prior to or during the step of attracting the sleeve against the support surface. Such gaseous medium may assist in freeing the sleeve from the wall(s) of the container.

The support surface could be movable relative to the one or more openings and the sleeve orientation unit could be configured to rotate the sleeve by moving the support surface relative to the one or more openings.

The vacuum unit could comprise a vacuum chamber connectable to a vacuum pump, wherein the vacuum chamber has an open end, and wherein the support surface is preferably arranged in or near the vacuum chamber in a manner partially covering the open end. In this manner, the one or more openings comprise that part of the open end that is not covered. More in particular, the vacuum chamber may be configured to apply a suction force to the sleeve through that part of the open end that is not covered by the support surface. As an example, when the supporting conveyor belt is a perforated supporting conveyor belt that at least partially covers the open end, the suction force may at least be partially exerted through the perforations in the perforated conveyor belt. Here, the one or more openings comprise the perforations in the conveyor belt.

The vacuum chamber may comprise a plurality of segments along the transport direction, wherein the vacuum is separately adjustable and/or different in each segment. As an example, a vacuum level of the most downstream segments is reduced with respect to other segments. This enables sleeves to gradually detach from the support surface to allow a smooth transition between the state in which the sleeves are held against the support surface and the state in which they are freely arranged around the container. It may even be possible to define vacuum profiles, indicating the level of vacuum along the support surface in the transport direction. For instance, when the support surface is formed by a conveyor belt that extends between a pair of wheels/rollers, the vacuum may be defined to be less near the wheels/rollers, to ensure a properly defined vacuum in between the wheels/rollers.

According to a second aspect, the object of the invention is also achieved with a method configured for orienting a tubular heat-shrinkable sleeve and a container that is being transported along a transport direction and around which the heat-shrinkable sleeve has been arranged, wherein the sleeve has not yet been finally shrunk. This method could comprise transporting the container on a conveyor belt of a conveyor in the transport direction, and could comprise determining, using a determining unit, an angular position difference between the container and the sleeve, preferably relative to an axis perpendicular to said conveyor belt. According to the invention, the method comprises a) providing a support surface, preferably arranged downstream of the determining unit and preferably at least on one side of the conveyor belt, wherein the support surface is arranged at a distance from the container(s) that is being transported preferably on the conveyor belt, and wherein the support surface is moveable in a direction parallel to the transport direction.

According to the invention, the method further comprises b) moving the support surface while holding the sleeve against the support surface in dependence of an angular position difference between the container and the sleeve thereby rotating the sleeve relative to the container.

The method could comprise rotating the sleeve while the sleeve is moving in said direction parallel to the transport direction and/or rotating the sleeve relative to the support surface.

The method could comprise determining a speed at which the support surface should move and/or a holding time during which the sleeve should be held against the support surface based on the determined angular position difference, and could comprise moving the support surface while holding the sleeve against the support surface based on the determined speed and/or the holding time.

The method may further comprise performing the above-mentioned steps on opposite sides of the conveyer belt.

The step of moving the support surface while holding the sleeve against the support surface may comprise rotating the sleeve from a starting position to an end position, wherein the sleeve is rotated from the starting position directly to the end position, or the sleeve is first rotated from its starting position to a predetermined reference position, and then rotated from the reference position to the end position, or the sleeve is first rotated in a first direction over a first angle, and then rotated over a second angle in a second direction opposite to the first direction.

The step of moving the support surface while holding the sleeve against the support surface may further or alternatively comprise moving a support surface on one side of the conveyor belt at a speed equaling a common speed and a first differential part and simultaneously moving a support surface on the other side of the conveyor belt at a speed equaling the common speed and a second differential part, wherein the first and second differential parts are equal in magnitude but opposite in direction.

The method may further comprise determining a further angular position difference between the container and the sleeve downstream of the sleeve orientation unit. Additionally, the method may comprise returning a container and sleeve to a position on the conveyor belt upstream of the sleeve orientation unit and determining unit if the further angular position difference exceeds a first predefined threshold, or removing a container and sleeve from the conveyor belt if the further angular position difference exceeds a second predefined threshold.

Additionally or alternatively, the method may further comprise determining a correlation between the angular position difference and control parameters for the support surface drive unit needed for correcting said difference using a self-learning algorithm that compares the angular position difference, the control parameters used for correcting the difference, and the further angular position difference observed after correcting the difference.

The sleeve may comprise an identifiable first reference point, such as an area or feature in a printed image on the sleeve. In this case, the determining of the angular position difference may comprise detecting, using a first detector, the angular position of the sleeve by identifying the first reference point, preferably relative to the axis perpendicular to the conveyor belt, wherein the angular position of the sleeve is preferably determined by comparing the identified first reference point to a corresponding first reference point in a first reference image. Furthermore, the angular position associated with the first reference image and/or the first reference point in that first reference image may be known. Furthermore, the container may comprise an identifiable second reference point, such as a physical structure, for example a recess or a protrusion, wherein the method further comprises determining the angular position difference from a distance between the first and second identifiable reference points. Alternatively, the angular position of the container may have a known value or may have been set to a known value upstream of the determining unit and sleeve orientation unit, the method further comprising determining the angular position difference by comparing the detected angular position of the sleeve with this known value.

The container may comprise an identifiable second reference point, such as a physical structure, for example a recess or a protrusion. In this case, the determining of the angular position difference may comprise detecting, using a second detector, the angular position of the container by identifying the second reference point, preferably relative to the axis perpendicular to the conveyor belt, wherein the angular position of the container is preferably determined by comparing the identified second reference point to a corresponding second reference point in a second reference image. Furthermore, the angular position associated with the second reference image and/or the second reference point in that second reference image may be known.

The determining of the angular position difference may comprise determining the angular position difference by subtracting the angular positions of the sleeve and the container as determined by the first and second detectors, respectively.

The holding of the sleeve against the support surface may comprise using a vacuum unit to apply a suction force through one or more openings, and the moving of the support surface may comprise moving the support surface relative to the one or more openings. More in particular, the holding of the sleeve against the support surface may comprise applying a vacuum to suck the sleeve against the support surface.

Next, the invention will be described in more detail referring to the appended drawings, wherein.

Figure 1:
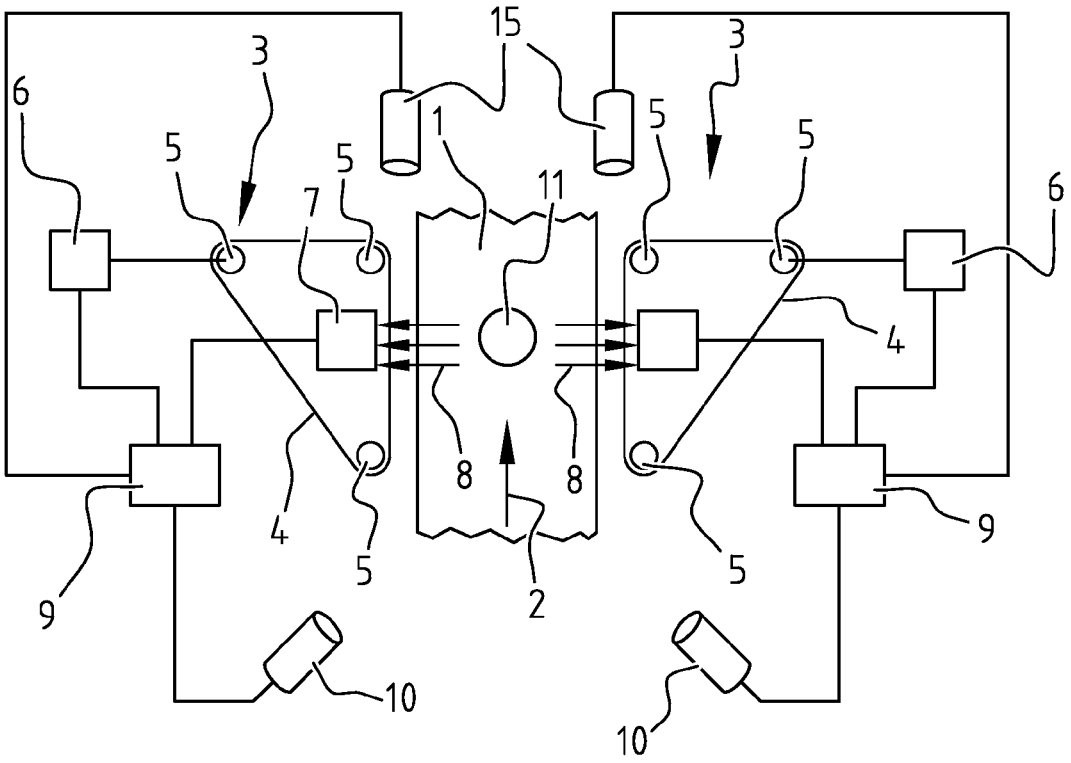
FIG. 1 illustrates a schematic overview of an embodiment of the present invention.
Figure 3:
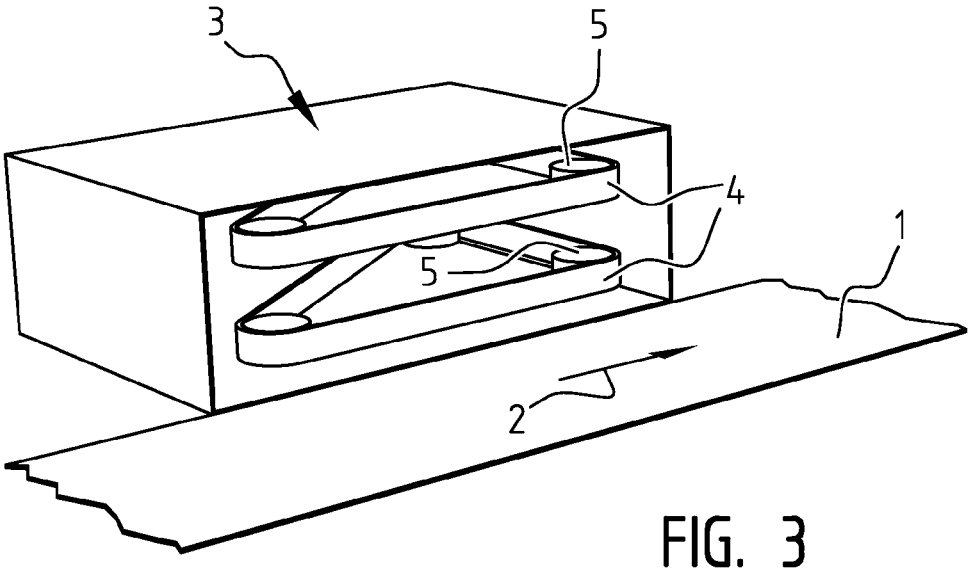
FIG. 3 illustrates an embodiment of a sleeve orientation unit.

FIG. 1 illustrates a schematic overview of an embodiment of the present invention. The apparatus shown in FIG. 1 comprises a conveyor having a moveable conveyor belt 1 for transporting a container (not shown) in a transport direction indicated by an arrow 2. On either side of conveyor belt 1, a sleeve orientation unit 3 is arranged of which a perspective view is shown in FIG. 3. Each unit 3 comprises a support surface in the form of a supporting conveyor belt 4 that is wound around wheels/rollers 5. One of these wheels/rollers is a driving wheel/roller 5 that drives supporting conveyor belt 4. This wheel/roller 5 is controlled by a support surface drive unit 6. Each unit 3 further comprises a vacuum unit 7 that applies a suction force indicated by arrows 8. Both the vacuum unit 7 and the support surface drive unit 6 are connected to a control unit 9. The latter receives input from an optical camera 10. In addition, the apparatus comprises a blow unit 11 for blowing a gaseous medium downward. The gaseous medium may comprise pressurized gas. Blowing the gaseous medium downward may help to detach a sleeve that is coupled to a container.

Optical cameras 15 may be arranged downstream of sleeve orientation unit 3. These cameras can be used to verify the orientation of the sleeve and/or to assist in a self-learning operation of control unit 9 as will be explained later.

Optical cameras 10, 15 are but an example of possible detectors. Other detecting means may equally be applied to detect an angular position or position difference from the top, side, or bottom of the container and/or sleeve. For instance, laser scanning techniques may be used to detect a protrusion or indentation on the container by scanning the container from the side, not excluding the front or the back.

Figure 2A:
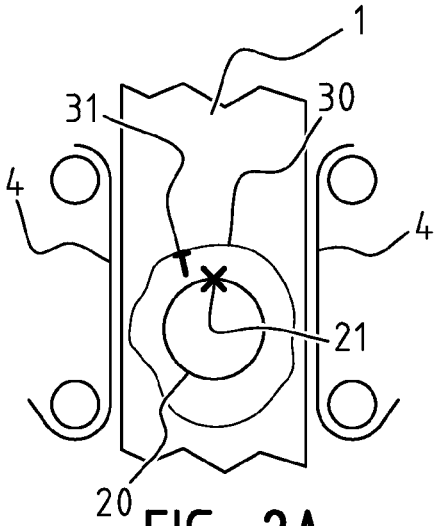
FIGS. 2A-2E depict various stages during the method of the present invention.

The operation of the apparatus of FIG. 1 will now be described referring to the FIGS. 2A-2E. In FIG. 2A, a container 20 is depicted having a protrusion at a location 21. In the same figure, a heat-shrinkable sleeve 30 is shown that is arranged around container 20. Sleeve 30 has a feature 31, such as a printed image, that should be placed at location 21 when sleeve 30 is shrunk.

In FIG. 2A, container 20 and sleeve 30 are transported on a conveyor belt 1. Moreover, in FIG. 2A, sleeve 30 is not touching support surfaces 4 that belong to respective sleeve orientation units that are disposed on both sides of conveyor belt 1. An angular position difference is determined between protrusion at location 21 and feature 31. An example how to determine such difference will be explained later.

Figure 2B:
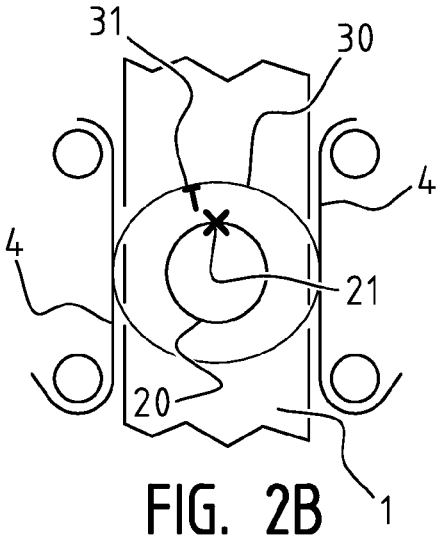

FIG. 2B depicts the situation in which the vacuum unit applies the suction force. This force may be applied continuously, the point in time wherein the sleeve is attracted due to this force being determined by the point in time where the sleeve comes into the vicinity of the sleeve orientation unit. Alternatively, the suction force may be applied intermittently. For instance, a detector could be used to detect when a container is in the vicinity of the sleeve orientation unit, and to control the vacuum unit accordingly.

In FIG. 2B, sleeve 30 is pulled against support surface 4 on either side of conveyor belt 1. As these support surfaces are moving, sleeve 30 will start to rotate with respect to container 20.

Figure 2C:
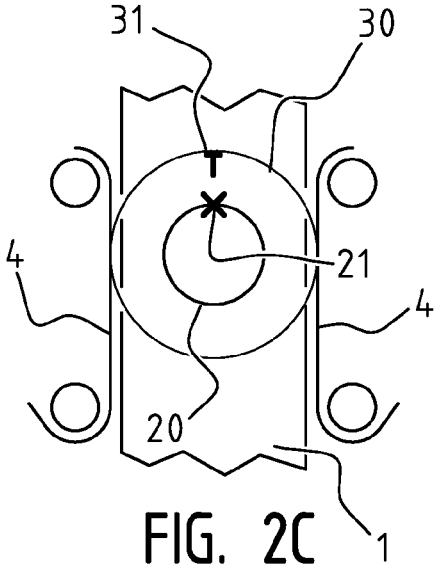
Figure 2D:
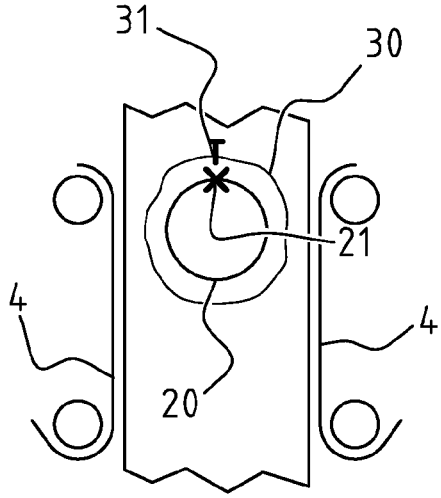
Figure 2E:
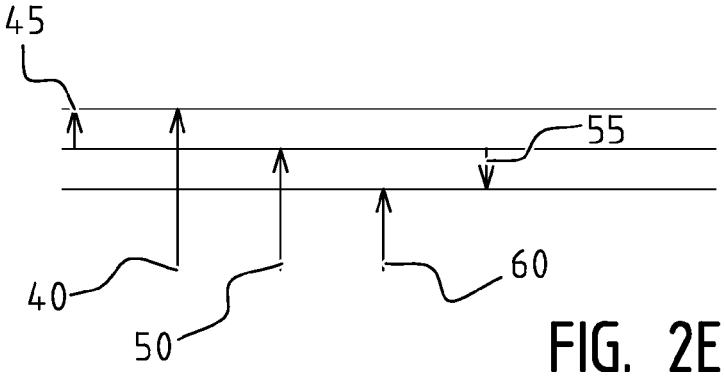

FIG. 2E illustrates the velocity vectors 40, 50, 60, corresponding to left support surface 4, container 20, and right support surface 4, respectively. Velocity vector 40 comprises a common part, which equals velocity vector 50 of container 20, and a differential part 45. Similarly, velocity vector 60 comprises a common part, which equals velocity vector 50 of container 20, and a differential part 55. As can be seen in FIG. 2E, differential parts 45, 55 are equal in magnitude but are opposite in direction.

Due to the different velocities of support surfaces 4, sleeve 30 will rotate counterclockwise while at the same time advancing at the same speed as container 20. It should be noted that the common part may be set to zero. This may for instance apply when conveyor belt 1 stops during the sleeve orientation, or when the displacement of container 20 during the sleeve orientating is negligible.

As can be seen in FIG. 2C, features 21, 31 are now aligned. At this point in time, sleeve 30 can be released from support surface 4 as shown in FIG. 2D. This can be achieved by switching off the vacuum, by gradually reducing the vacuum, or simply because support surface 4 ends as shown in FIG. 1.

During operation, control unit 9 will control support surface drive units 6 using a plurality of control parameters. In the example above, the support surfaces are configured to move at a well defined speed during the sleeve orientation. In such case, the only relevant parameters may be the speed of the support surface and/or the holding time during which the sleeve is held against this support surface. In some situations however, the speed is not constant as the support surface may accelerate or decelerate between speeds. Then, also the acceleration or deceleration constant, or the time during which the support surface changes speeds as well as the starting and ending speed may form control parameters.

Control unit 9 may be self-learning. For instance, it may use input from optical cameras 15 which record a further angular position difference downstream of sleeve orientation units 3. The determination of the further angular position difference may be performed similar to the determination of the angular position difference upstream of sleeve orientation units 3. Control unit 3 may determine a correlation, such as a lookup table, between the upstream angular position difference, the control parameters that are used to correct this difference, and the resulting downstream angular position difference. The correlation should enable control unit 9 to select the appropriate control parameters to reduce the angular position difference to acceptable levels.

FIG. 3 shows a side view of a sleeve orientation unit 3 used in FIG. 1. As can be seen, several supporting conveyor belts 4 are mounted around wheels/rollers in a vertically spaced apart manner. The vacuum unit, arranged inside sleeve orientation unit 3, attracts sleeves towards supporting conveyor belts 4. Additionally or alternatively, supporting conveyor belts 4 may be perforated. In this case, the vacuum may be applied to sleeve 30, either fully or partially, through the perforation of supporting conveyor belt 4.

Figure 4A:
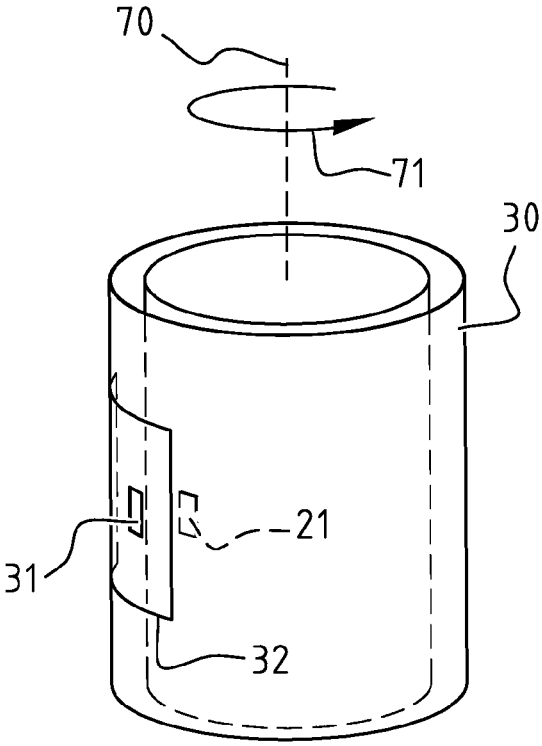
FIGS. 4A-4B illustrate the process of aligning a sleeve and container.

FIG. 4A illustrates the general concept of the present invention. Here, sleeve 30 comprises a printed image 32 having a feature 31. Container 20 comprises four protrusions 21 that in the final product should be covered by feature 31. Hence, sleeve 30 should be rotated as indicated by arrow 71 around an axis 70 that is perpendicular to the supporting surface of container 20, for instance conveyor belt 1.

Figure 4B:
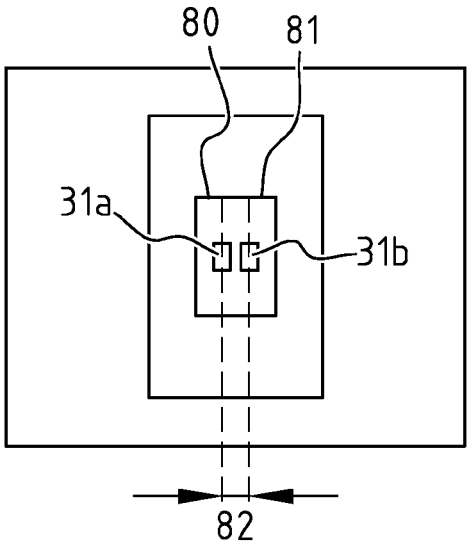

FIG. 4B illustrates an example of a comparison between a reference image of a sleeve and an image recorded by an optical camera 10 of sleeve 30. Here, it is assumed that sleeve 30 is at the same position as the sleeve in the reference image, and that sleeve 30 is only rotated compared to the sleeve in the reference image. A difference 82 in position can be observed between the position of feature 31*a* in recorded image 80 and the corresponding position of the same feature 31*b* in reference image 81. In this example, reference image 81 corresponds to the situation wherein the printed image is arranged in the middle. This is not mandatory. The observed difference can be used to compute the angular position difference.

Figure 5:
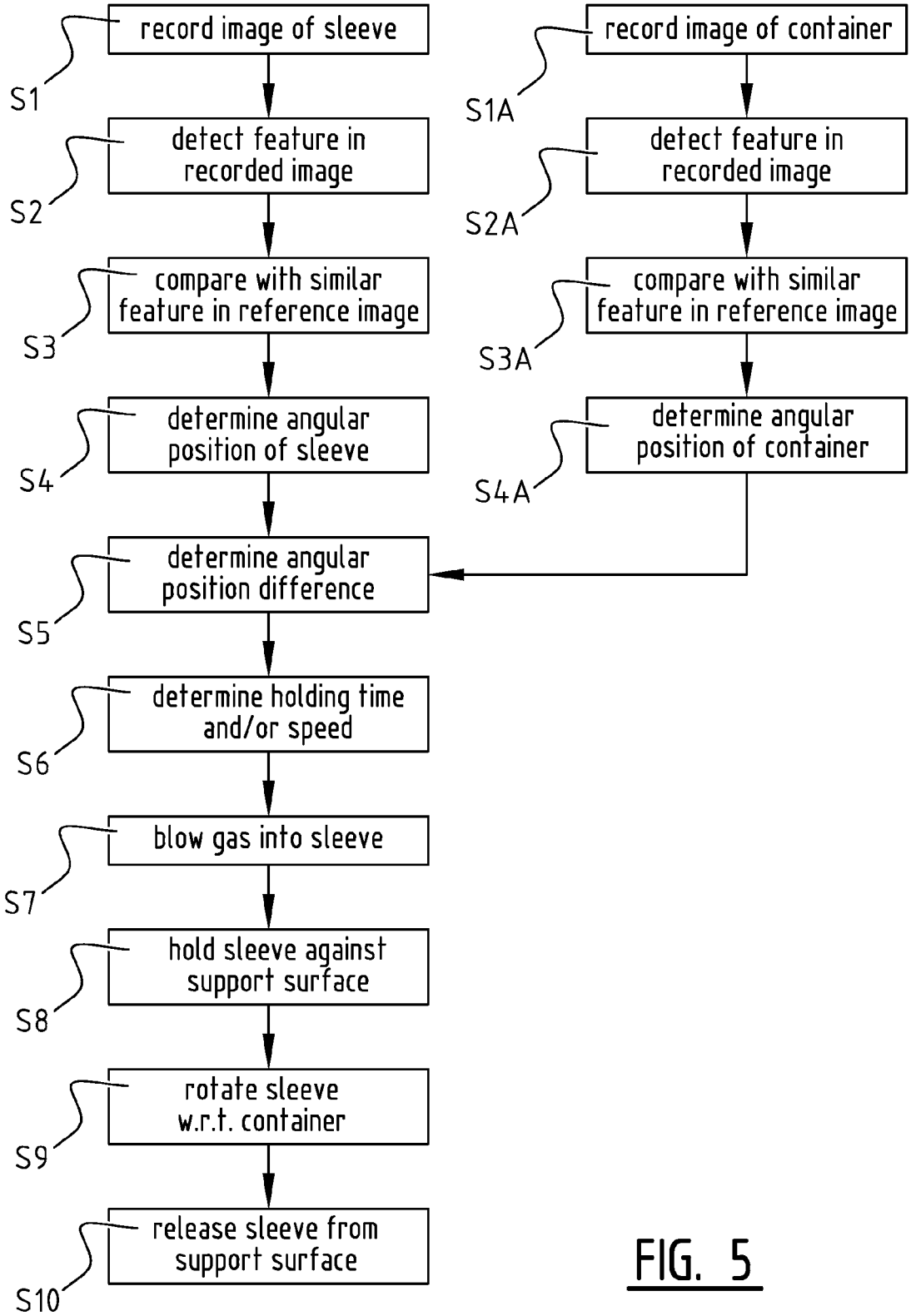
FIG. 5 illustrates an example of a method in accordance with the present invention.

FIG. 5 illustrates an example of a method in accordance with the present invention. The method starts with a container, around which a sleeve is arranged, being transported on a conveyor belt towards a sleeve orientation unit.

First, in step S1, an image is recorded of the sleeve that is arranged around the container. Optionally, in step S1A an image is recorded of the container itself. Subsequently, in step S2, a feature in the recorded image of the sleeve is detected. This feature is also present in a reference image of the sleeve, wherein the reference image is associated with the sleeve in a predefined or otherwise known angular position. Optionally, in step S2A, a feature is also detected in the recorded image of the container. This feature is also present in a reference image of the container, wherein the reference image is associated with the container in a predefined or otherwise known angular position.

In step S3, the detected feature in the recorded image of the sleeve is compared with the corresponding feature in the reference image. This allows the angular position of the sleeve to be determined in step S4.

Optionally, in step S3A, the detected feature in the recorded image of the container is compared with the corresponding feature in the reference image. This allows the angular position of the container to be determined in step S4A.

In step S5, the angular position difference between the sleeve and container is determined. This difference is determined using the determined angular position of the sleeve, and optionally the determined angular position of the container. Based on the angular position difference, a holding time and/or speed of the support surface(s) of the sleeve orientation unit can be determined in step S6.

When the container advances even more towards the sleeve orientation unit, gas is optionally blown into the sleeve in step S7 to enable the sleeve to detach from the container. Subsequently, the sleeve is held against the support surface in step S8 based on the determined holding time and/or speed. In step S9, the sleeve is rotated with respect to the container, preferably by moving the support surface(s) at the determined speed with the sleeve held there against and/or by holding the sleeve during the determined holding time. Then, in step S10, the sleeve is released from the support surface.

Figure 6:
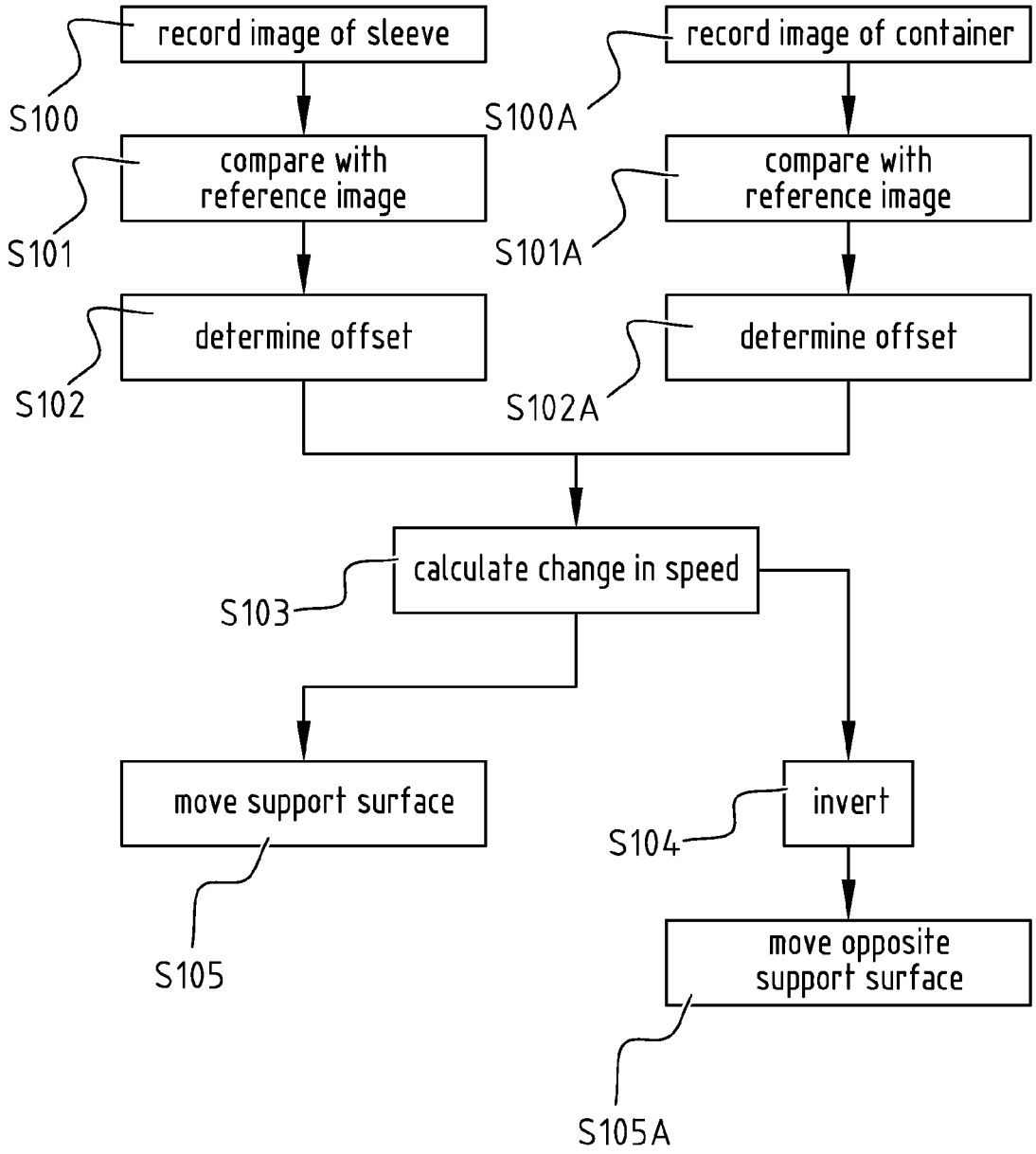
FIG. 6 illustrates a further example of the method in accordance with the present invention.

FIG. 6 illustrates a further example of a method according to the invention. Here, in steps 100 and 100A, an image of the sleeve and container are recorded upstream of the sleeve orientation unit, respectively. In steps 101 and 101A, the recorded images are compared to corresponding reference images, which in steps 102 and 102A result in determined offsets. These offsets correspond to the difference in angular position between the sleeve or container in the recorded image and the corresponding reference image. For instance, the reference image of the sleeve may correspond to a sleeve rotation of 10 degrees. By comparing this reference image to an actual image of the sleeve, an offset may be determined Assuming that the sleeve is not rotated, an offset of −10 degrees may be calculated.

In step S103 a change in speed of the support surfaces is calculated based on the determined offsets. This assumes that a correlation is known between the angular positions of the sleeve and containers in their corresponding reference images. For instance, if the actual and reference angular positions of the sleeve equal POS_sleeve and POS_sleeve_ref, respectively, and if the actual and reference angular positions of the container equal POS_con and POS_con_ref, respectively, the angular position difference POS_dif can be computed from:

$$POS_dif=(POS_sleeve-POS_sleeve_ref)-(POS_con-POS_con_ref)+(POS_sleeve_ref-POS_con_ref)$$

wherein POS_sleeve−POS_sleeve_ref corresponds to the offset that can be determined by comparing the recorded image of the sleeve to the reference image of the sleeve, wherein POS_con−POS_con_ref corresponds to the offset that can be determined by comparing the recorded image of the container to the reference image of the container, and wherein POS_sleeve_ref−POS_con_ref equals the angular position difference between the sleeve and the container if these are at the positions corresponding to their reference images.

In step S104, the calculated value in step S103 is inverted. Consequently, the changes in speed for the support surfaces on opposite sides of the conveyor belt are opposite in sign. As an example, prior to orienting the sleeve, the support surfaces on both sides of the conveyor belt move at a speed that equals the speed of the conveyor belt on which the container is transported. This speed is the common speed, denoted as Vcontainer. Then, based on the detected offsets, a change of speed is computed equaling Vsleeve. As a result, one support surface is moved at Vcontainer+Vsleeve, whereas the other support surface moves at Vcontainer−Vsleeve, in steps S105 and S105A, respectively.

As can be deduced from the above, the invention allows the mutual orientation of the sleeve and container. According to the invention, the physical structure of the sleeve and/or a printed image thereon can be oriented with respect to a physical structure of the container. Instead of a physical structure, a printed image on the container may equally be used.

Furthermore, the angular position difference could also directly be determined, for instance using a single recorded image, in which image the necessary features of the sleeve and container can be identified.

The position of the camera can be varied depending on the feature to be captured. For instance, some protrusions can best be captured by a camera mounted above the container, whereas a printed image on a sleeve can best be determined by mounting a camera in a horizontal manner facing the sleeve.

It should be obvious to the skilled person that many more variations to the embodiments shown are possible without departing from the scope of the invention, which is defined by the appended claims and their equivalents.

For instance, the present invention does not exclude the possibility of simultaneously orienting a plurality of sleeves relative to a plurality of containers. This may be advantageous if the angular position difference between sleeve and container is relatively large for each of the plurality of sleeve container combinations. In this case, the process of orienting the sleeves may be divided in a course part and a fine part, wherein during the course part, several sleeves are substantially equally oriented relative to the corresponding containers. During the fine part, each sleeve container combination can be individually mutually oriented to correct for differences in the angular position difference between different sleeve container combinations.

Furthermore, although the specification above discloses mathematical equations that can be used for correcting an angular position difference between sleeve and container, it must be noted that in practical situations small corrections may prove necessary to achieve a certain tolerance. To that end, the further determining unit mentioned above may be used. The control parameters used for orienting the sleeve may be adapted based on an angular position difference between sleeve and container determined downstream of the sleeve orientation unit.

The invention claimed is:

1. An apparatus for orienting a tubular heat-shrinkable sleeve relative to a container that is being transported along a transport direction and around which the heat-shrinkable sleeve has been arranged, wherein the sleeve has not yet been finally shrunk, the apparatus comprising:

a sleeve orientation unit, comprising:

a support surface arranged at a distance from the container, the support surface being moveable in a direction parallel to the transport direction;

a holding unit configured to hold the sleeve against the support surface;

wherein the sleeve orientation unit is configured is rotate the sleeve relative to the container in dependence of an angular position difference between the container and the sleeve by moving the support surface while the sleeve is held against the support surface.

2. The apparatus according to claim 1, wherein the sleeve orientation unit is configured to rotate the sleeve relative to the support surface.

3. The apparatus according to claim 1, further comprising a conveyor having a moveable conveyor belt for transporting the container in the transport direction, wherein the sleeve orientation unit is configured to rotate the sleeve while the sleeve is moving in direction parallel to the transport direction.

4. The apparatus according to claim 1, further comprising a determining unit for determining the angular position difference, relative to an axis perpendicular to the conveyor belt, wherein the support surface is arranged downstream of the determining unit and at least on one side of the conveyor belt;

wherein the sleeve orientation unit further comprises a support surface drive unit for moving the support surface at a predefined speed, and a control unit configured to determine a speed at which the support surface moves and/or a holding time during which the sleeve is held against the support surface based on the determined angular position difference and to control the holding unit and/or support surface drive unit using the determined holding time and/or speed.

5. The apparatus according to claim 4, wherein the control unit is configured to control the support surface drive unit to rotate the sleeve from a starting position to an end position, wherein:

the sleeve is rotated from the starting position directly to the end position, or the sleeve is first rotated from its starting position to a predetermined reference position, and then rotated from the reference position to the end position, or the sleeve is first rotated in a first direction over a first angle, and then rotated over a second angle in a second direction opposite to the first direction.

6. The apparatus according to claim 4, comprising a further determining unit configured for determining a further angular position difference between the container and the sleeve downstream of the sleeve orientation unit, the apparatus further comprising at least one of a return unit and a rejection unit arranged downstream of the sleeve orientation unit, wherein the return unit is configured to return a container and sleeve to a position upstream of the sleeve orientation unit if the further angular position difference exceeds a first predefined threshold, and wherein the rejection unit is configured to remove a container and sleeve if the further angular position difference exceeds a second predefined threshold;

wherein the control unit is further configured to determine a correlation between the angular position difference and control parameters for the support surface drive unit needed for correcting the difference, wherein the control unit is configured to determine the correlation using a self-learning algorithm that compares the angular position difference, the control parameters used for correcting the difference, and the further angular position difference observed after correcting the difference.

7. The apparatus according to claim 4, wherein the determining unit comprises a first detector for detecting the angular position of the sleeve, wherein the first detector comprises an optical camera;

wherein the sleeve comprises an identifiable first reference point, an area or feature in a printed image on the sleeve, and wherein the first detector is configured to detect the angular position of the sleeve by identifying the first reference point;

wherein the angular position of the sleeve is determined by comparing the identified first reference point to a corresponding first reference point in a first reference image, wherein the angular position associated with the first reference image and/or the first reference point in that first reference image is known;

wherein:

the container comprises an identifiable second reference point, a physical structure wherein the first detector is configured to determine the angular position difference from a distance between the first and second identifiable reference points; or wherein the angular position of the container has a known value or has been set to a known value upstream of the detection unit and sleeve orientation unit, wherein the angular position difference is determined by the detection unit or the control unit by comparing the detected angular position of the sleeve with known value; or wherein the sleeve comprises a folding line and wherein the sleeve has been arranged around the container in a manner that the orientation of the folding line relative to the container is known, and wherein an angular offset between an image printed on the sleeve relative to an intended position of the image on the sleeve is known or detected by the first detector, wherein the determining unit is configured to determine the angular position difference by comparing the angular offset and the known orientation of the folding line relative to the container; or wherein the determining unit comprises a second detector for detecting the angular position of the container, wherein the second detector comprises an optical camera, wherein the container comprises an identifiable second reference point, a physical structure and wherein the second detector is configured to detect the angular position of the container by identifying the second reference point, wherein the angular position of the container is determined by comparing the identified second reference point to a corresponding second reference point in a second reference image, wherein the angular position associated with the second reference image and/or the second reference point in that second reference image is known, wherein the determining unit is configured to determine the angular position difference by subtracting the angular positions of the sleeve and the container as determined by the first and second detectors, respectively.

8. The apparatus according to claim 1 wherein the support surface is formed by a supporting conveyor belt that is configured to support the sleeve along a predetermined length along the transport direction;

wherein the supporting conveyor belt is wound around a pair of rollers/wheels that are spaced apart along the transport direction, wherein the sleeve orientation unit comprises a plurality of the supporting conveyor belts that are spaced apart.

9. The apparatus according to claim 1, wherein the holding unit comprises:

an injector for injecting a gaseous medium into the sleeve to push the sleeve against the support surface; and/or an electrostatic unit comprising a voltage source for applying an electrostatic voltage between the support surface and sleeve to attract the sleeve towards the support surface and to hold it there against using static electricity; and/or a vacuum unit being arranged for holding the sleeve against the support surface by applying a suction force through one or more openings.

10. The apparatus according to claim 9, wherein the support surface is movable relative to the one or more openings and wherein the sleeve orientation unit is configured to rotate the sleeve by moving the support surface relative to the one or more openings.

11. The apparatus according to claim 9, wherein the vacuum unit comprises a vacuum chamber connectable to a vacuum pump, the vacuum chamber having an open end, wherein the support surface is arranged in or near the vacuum chamber in a manner partially covering the open end.

12. The apparatus according to claim 11, wherein the vacuum chamber is configured to apply a suction force to the sleeve through that part of the open end that is not covered by the support surface; and/or wherein the support surface is formed by a supporting conveyor belt that is configured to support the sleeve along a predetermined length along the transport direction, wherein the supporting conveyor belt is wound around a pair of rollers/wheels that are spaced apart along the transport direction, and wherein the sleeve orientation unit comprises a plurality of said supporting conveyor belts that are spaced apart, wherein the supporting conveyor belt is perforated and which supporting conveyor belt at least partially covers the open end, wherein the suction force is at least partially exerted through the perforations in the perforated conveyor belt; and/or wherein the vacuum chamber comprises a plurality of segments along the transport direction, wherein the vacuum is separately adjustable or different in each segment, wherein a vacuum level of the most downstream segments is reduced with respect to other segments.

13. The apparatus according to claim 1, comprising a pair of the sleeve orientation units, wherein the sleeve orientation units are arranged on opposite sides of the conveyor belt, wherein the support surfaces of the oppositely arranged sleeve orientation units are configured to each move at a speed that comprises a common part and a differential part, wherein the common parts are equal in both direction and magnitude, and wherein the differential parts are equal in magnitude but have an opposite direction.

14. A method for orienting a tubular heat-shrinkable sleeve and a container that is being transported along a transport direction and around which the heat-shrinkable sleeve has been arranged, wherein the sleeve has not yet been finally shrunk, comprising:

a) providing a support surface arranged at a distance from the container, and wherein the support surface is moveable in a direction parallel to the transport direction;

b) moving the support surface while holding the sleeve against the support surface in dependence of an angular position difference between the container and the sleeve thereby rotating the sleeve relative to the container;

the method further comprising transporting the container in the transport direction using a conveyor having a moveable conveyor belt, and rotating the sleeve while the sleeve is moving in the direction parallel to the transport direction and/or rotating the sleeve relative to the support surface;

the method further comprising determining the angular position difference between the container and the sleeve, determining a speed at which the support surface should move and/or a holding time during which the sleeve should be held against the support surface based on the determined angular position difference.

15. The method according to claim 14, wherein the holding the sleeve against the support surface comprises using a vacuum unit to apply a suction force through one or more openings, the moving the support surface moving the support surface relative to the one or more openings.

* * * * *